US006143127A

United States Patent [19]

Perlov et al.

[11] Patent Number: 6,143,127

[45] Date of Patent: Nov. 7, 2000

[54] CARRIER HEAD WITH A RETAINING RING FOR A CHEMICAL MECHANICAL POLISHING SYSTEM

[75] Inventors: Ilya Perlov; Eugene Gantvarg, both of Santa Clara, Calif.

[73] Assignee: Applied Materials, Inc., Santa Clara, Calif.

[21] Appl. No.: 09/079,009

[22] Filed: May 14, 1998

[51] Int. Cl.[7] ..... B24B 5/00; B24B 29/00

[52] U.S. Cl. ..... 156/345; 451/285; 451/286; 451/287

[58] Field of Search ..... 156/345; 216/88–91; 438/690–693; 451/41, 285–289

[56] References Cited

U.S. PATENT DOCUMENTS 5,205,082 4/1993 Shendon et al. .
5,398,459 3/1995 Okumura et al. .
5,423,716 6/1995 Strasbaugh .
5,441,444 8/1995 Nakajima .
5,584,746 12/1996 Tanaka et al. ..... 451/41
5,584,751 12/1996 Kobayashi et al. .
5,635,083 6/1997 Breivogel et al. ..... 216/88

FOREIGN PATENT DOCUMENTS 0 589 433 A1 3/1994 European Pat. Off. .
0 599 299 A1 6/1994 European Pat. Off. .

*Primary Examiner*—Jeffrie R Lund
*Assistant Examiner*—Alva C Powell
*Attorney, Agent, or Firm*—Fish & Richardson

[57] ABSTRACT

A carrier head for chemical mechanical polishing with a retaining ring having an inclined inner surface. The force of the edge of the substrate against the inclined surface causes a reactive force having a vertical component on the edge of the substrate. This vertical force can reduce the edge effect.

10 Claims, 5 Drawing Sheets

CARRIER HEAD WITH A RETAINING RING FOR A CHEMICAL MECHANICAL POLISHING SYSTEM

BACKGROUND

The present invention relates generally to chemical mechanical polishing of substrates, and more particularly to a carrier head for a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad. The interaction of the polishing pad and the abrasive particles with the reactive sites results in polishing.

Typically, the carrier head includes a retaining ring. The retaining ring is positioned around the substrate to hold it beneath the carrier head. The retaining ring may be directly attached to the carrier head, or it may be connected to the carrier head by a flexible connector, such as a flexible membrane or bellows.

An effective CMP process should provide a high polishing rate yet generate a substrate surface that is finished (lacks small-scale roughness) and flat (lacks large-scale topography). The polishing rate, finish and flatness are determined by the pad and slurry combination, the relative speed between the substrate and pad, and the force pressing the substrate against the pad. Because inadequate flatness and finish can create defective substrates, the selection of a polishing pad and slurry combination is usually dictated by the required finish and flatness. Given these constraints, the polishing rate sets the maximum throughput of the polishing apparatus.

Among other factors, the polishing rate depends upon the force with which the substrate is pressed against the pad. Specifically, the greater this force, the higher the polishing rate. If force pressure is applied to one region of the substrate than to another, then the high pressure regions will be polished faster than the low pressure regions. Therefore, this will result in non-uniform polishing of the substrate.

One problem is that the edge of the substrate is often polished at a different rate (usually faster, but occasionally slower) than the center of the substrate. This problem, termed the "edge effect", may occur even if the load is uniformly applied to the substrate. The edge effect typically occurs in the perimeter portion, e.g., the outermost five to ten millimeters, of the substrate. The edge effect reduces the overall flatness of the substrate, makes the perimeter portion of the substrate unsuitable for integrated circuits, and decreases substrate yield.

Therefore, there is a need for a CMP apparatus that optimizes polishing throughput while providing the desired flatness and finish. Specifically, the CMP apparatus should have a carrier head which provides substantially uniform polishing of a substrate.

SUMMARY

In one aspect, the invention is directed to a carrier head for a chemical mechanical polishing system. The carrier head has a substrate mounting surface and a retaining ring to maintain a substrate beneath the mounting surface. The retaining ring has an inner surface with an inclined region, and the inclined region positioned to contact an edge of a substrate if the substrate is located adjacent the mounting surface and is being polished. This applies a force having a vertical component to the edge of the substrate.

In another aspect, the invention is directed to a retaining ring for a carrier head. The retaining ring includes a generally annular body having an inner surface with an inclined region positioned to contact an edge of a substrate if the substrate is located adjacent a mounting surface of the carrier head.

In another aspect, the invention is directed to a method of polishing a substrate. In the method, a substrate is positioned adjacent a mounting surface of a carrier head which includes a retaining ring having an inner surface with an inclined region. The substrate is contacted with a polishing pad, and the polishing pad is moved relative to the substrate so that the substrate is urged against the retaining ring and the inclined region generates a force having a vertical component on the edge of the substrate.

Implementations of the invention may include the following. The inclined region may be sloped inwardly or outwardly from the top to the bottom of the retaining ring. The vertical component of the force may tend to lift the edge of the substrate away from a polishing pad during polishing, or press the edge of the substrate toward the polishing pad during polishing. The inner surface of the retaining ring may have a substantially vertical region and a horizontal surface extending between the vertical region and the inclined region to form an overhang. A lower surface of the retaining ring may contact the polishing pad during polishing. There may be an angle θ, e.g., between about 7 and 13 degrees, between the inclined region and an axis substantially perpendicular to a surface of a polishing pad against which the substrate is pressed during polishing. The retaining ring may be substantially annular in shape.

Advantages of the invention include the following. The carrier head reduces the edge effect and improves polishing uniformity.

Other advantages and features of the present invention will become apparent from the following description, including the drawings and claims.

DETAILED DESCRIPTION

Figure 1:
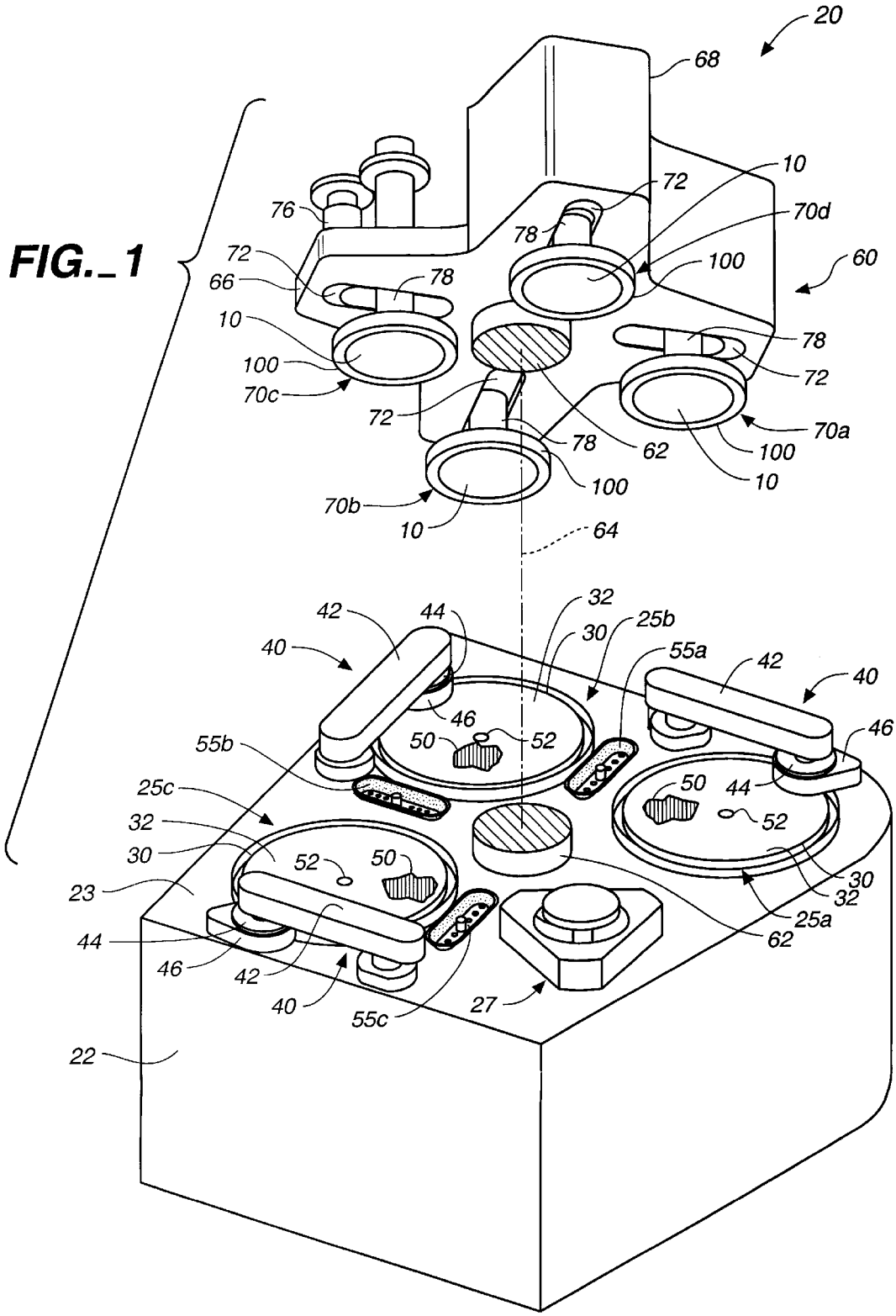
FIG. 1 is a schematic exploded perspective view of a chemical mechanical polishing apparatus.

Referring to FIG. 1, one or more substrates 10 will be polished by a chemical mechanical polishing (CMP) apparatus 20. A complete description of CMP apparatus 20 may be found in U.S. Pat. No. 5,738,574, the entire disclosure of which is hereby incorporated by reference.

The CMP apparatus 20 includes a lower machine base 22 with a table top 23 mounted and a removable upper outer cover (not shown). The table top 23 supports a series of polishing stations 25*a*, 25*b* and 25*c*, and a transfer station 27. The transfer station 27 serves multiple functions of transferring the individual substrates to and from a loading apparatus (not shown), washing the substrates, and transferring the substrates to and from carrier heads (to be described below).

Each polishing station 25*a*–25*c* includes a rotatable platen 30 on which is placed a polishing pad 32. If the substrate 10 is an eight-inch (200 mm) diameter disk, then the platen 30 and the polishing pad 32 will be about twenty inches in diameter. The platen 30 may be connected by a platen drive shaft (not shown) to a platen drive motor (also not shown) located in the machine base 22.

The polishing pad 32 may be a composite material with a roughened polishing surface. The polishing pad 32 may be attached to the platen 30 by a pressure-sensitive adhesive layer. A two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.).

Each polishing station 25*a*–25*c* may further include an associated pad conditioner apparatus 40. The conditioner apparatus 40 maintains the condition of the polishing pad so that it will effectively polish any substrate pressed against it while it is rotating.

A slurry 50, containing a reactive agent (e.g., deionized water for oxide polishing), abrasive particles (e.g., silicon dioxide for oxide polishing) and a chemically-reactive catalyzer (e.g., potassium hydroxide for oxide polishing), is supplied to the surface of the polishing pad 32 by a slurry supply port 52 in the center of the platen 30.

A rotatable multi-head carousel 60 is positioned above the lower machine base 22. The carousel 60 is supported by a center post 62 and rotated thereon by a carousel motor assembly (not shown) located within the base 22. The center post 62 supports a carousel support plate 66 and a cover 68. The carousel 60 includes four carrier head assemblies 70*a*, 70*b*, 70*c*, and 70*d*. The center post 62 allows the carousel motor to orbit the carrier head assemblies 70*a*–70*d*, and the substrates attached thereto, between the polishing stations 25*a*–25*c* and the transfer station 27.

Each carrier head assembly 70*a*–70*d* includes a carrier head 100, three pneumatic actuators 74 (see FIG. 2), and a carrier drive motor 76 (shown in FIG. 1 by the removal of one-quarter of the cover 68). Each carrier head 100 independently rotates about its own axis, and independently laterally oscillates in its own radial slot 72. Each carrier drive motor 76 is connected to a carrier drive shaft assembly 78 which extends through the radial slot 72 to the carrier head 100. There is one carrier drive shaft assembly and motor for each head.

During actual polishing, three of the carrier heads, e.g., those of carrier head assemblies 70*a*–70*c*, are positioned at and above the respective polishing stations 25*a*–25*c*. The pneumatic actuators lower the carrier head 100 and the substrate attached thereto into contact with the polishing pad 32. A slurry 50 acts as the media for chemical mechanical polishing of the substrate. Generally, the carrier head 100 holds the substrate against the polishing pad and evenly distributes a downward pressure across the back surface of the substrate.

Figure 2:
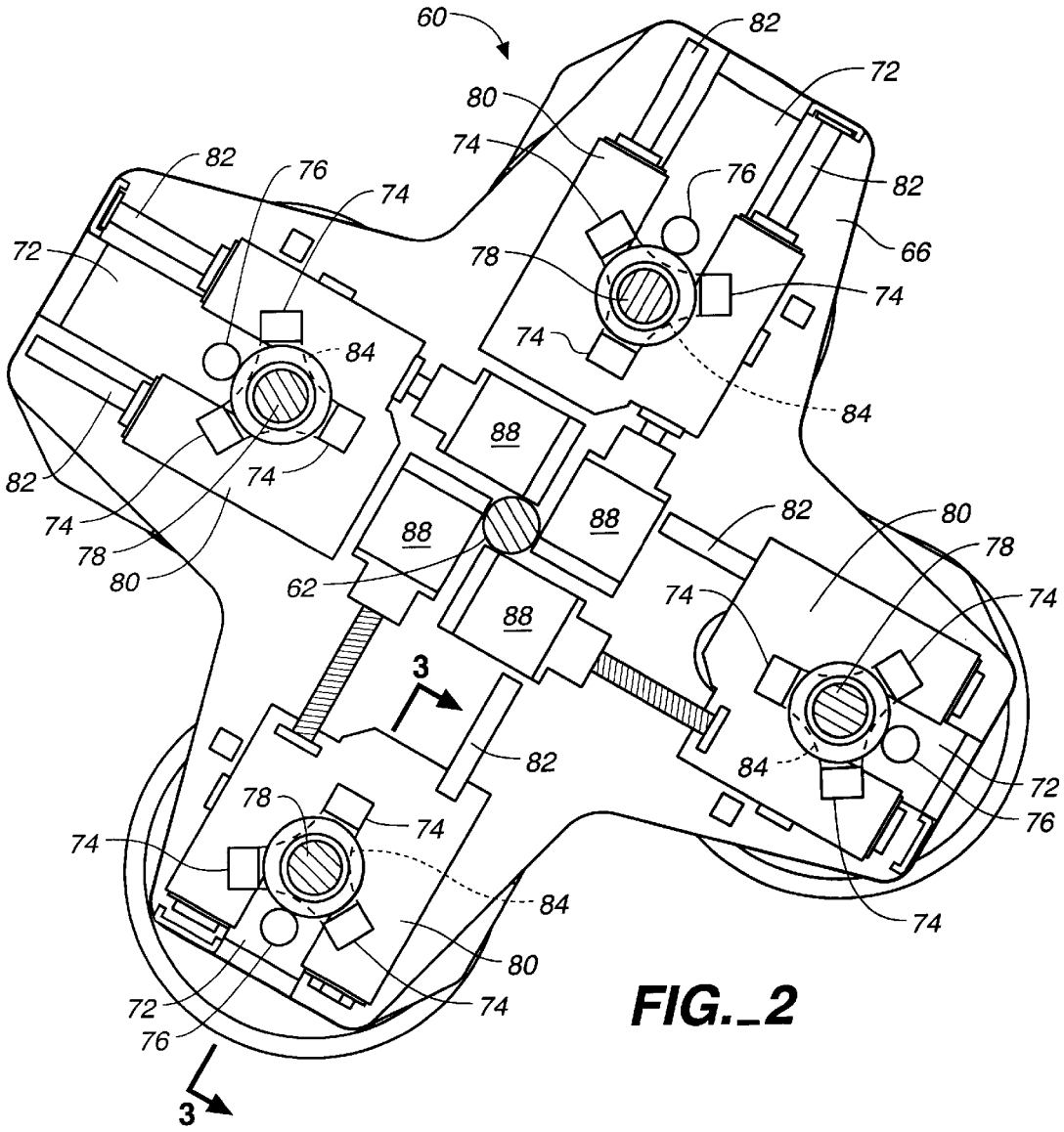
FIG. 2 is a schematic top view of a carousel of FIG. 1, with the upper housing removed.

Referring to FIG. 2, in which the cover 68 of the carousel 60 has been removed, the carousel support plate 66 supports four support slides 80. Each slide 80 may be driven radially by a slide radial oscillator motor 88 to independently move along an associated radial slot 72. Three pneumatic actuators 74 are mounted on each slide 80 and are connected by an arm 84 (shown in phantom) to the carrier drive shaft assembly 78. The pneumatic actuators 74 control the vertical position of the arm 84, the carrier drive shaft assembly 78, and the carrier head 100 attached thereto.

Figure 3:
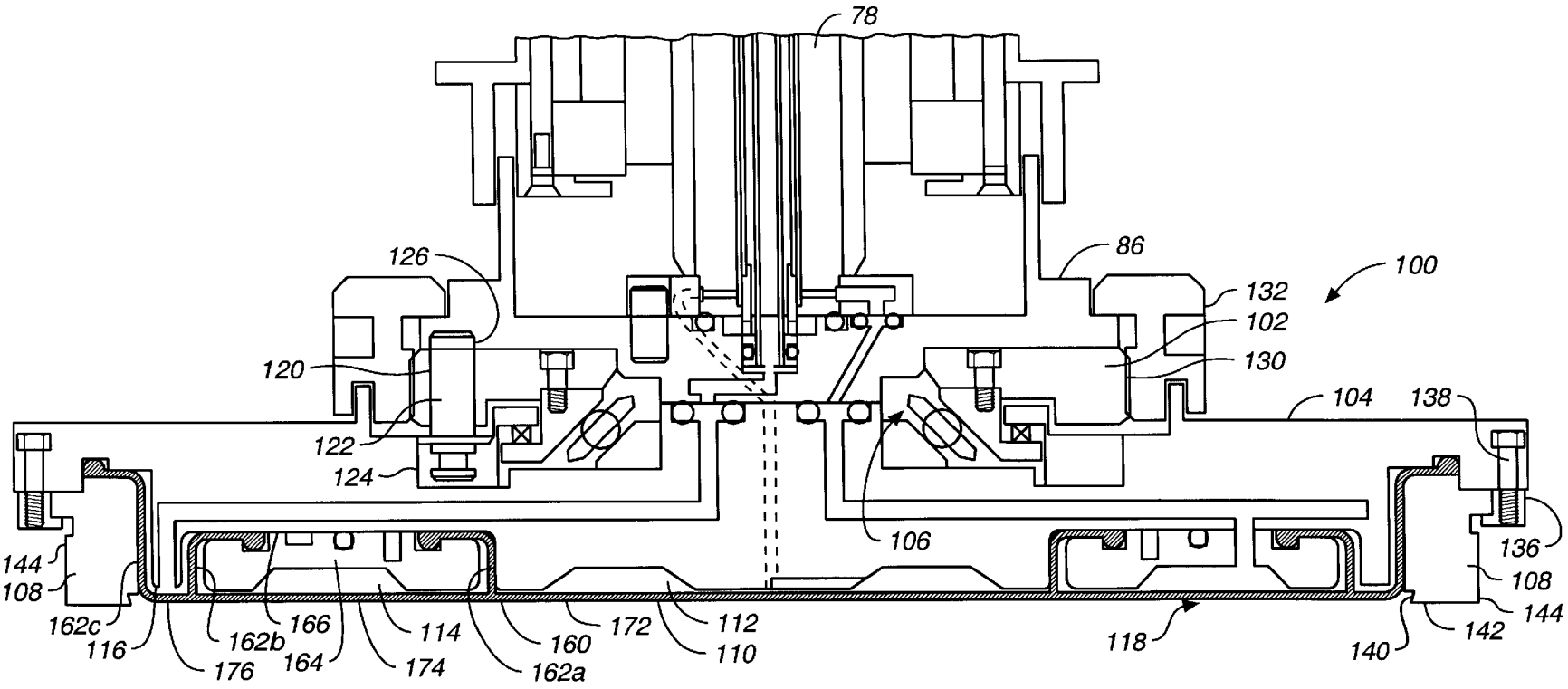
FIG. 3 is a schematic cross-sectional view of the carrier head.

Referring to FIG. 3, the carrier head 100 includes a housing flange 102, a carrier base 104, a gimbal mechanism 106, a retaining ring 108, and a flexible membrane 110. A more detailed description of a similar carrier head may be found in U.S. patent application Ser. No. 08/891,548, filed Jul. 11, 1997, entitled A CARRIER HEAD WITH A FLEXIBLE MEMBRANE FOR A CHEMICAL MECHANICAL POLISHING SYSTEM, by Perlov et al., the entirety of which is hereby incorporated by reference.

The housing flange 102 may be connected to a drive shaft flange 86 at the bottom of the drive shaft assembly 78. The carrier base 104 is pivotally connected to the housing flange 102 by the gimbal mechanism 106, but rotates with the drive shaft assembly 78. The flexible membrane 110 is connected to the carrier base 104 and defines three chambers, an inner chamber 112, a middle chamber 114 surrounding the inner chamber 112, and an outer chamber 116 surrounding the middle chamber 114. Pressurization of the chambers 112, 114 and 116 controls the downward pressure of the substrate against the polishing pad 32. The retaining ring 108 is secured to the perimeter of the carrier base 104 to hold the substrate beneath the flexible membrane 110 during polishing.

To secure the carrier head to the drive shaft flange 86, a perimeter nut 132 may be screwed onto a threaded neck 130 of the housing flange 102. When the carrier head 100 is thus connected to the drive shaft assembly 78, three vertical torque transfer pins 122 (only one of which is shown due to the cross-sectional view) extend through three passages 120 (again, only one is shown) and fit into receiving recesses 124 and 126 in the carrier base 104 and the drive shaft flange 86, respectively, to transfer torque between the carrier base 104 and the drive shaft assembly 78.

The carrier base 104 in this embodiment is a generally disc-shaped body located beneath the housing flange 102 which may have a diameter somewhat larger than the diameter of the substrate to be polished. As previously mentioned, the carrier base 104 is connected to the housing flange 102 by the gimbal mechanism 106. The gimbal mechanism 106 permits the carrier base 104 to pivot with respect to the housing flange 102 so that the carrier base 104 can remain substantially parallel to the surface of the polishing pad. However, the gimbal mechanism 106 prevents the carrier base 104 from moving laterally, i.e., parallel to the surface of the polishing pad 32. The gimbal mechanism 106 also transfers the downward pressure from the drive shaft assembly 78 to the carrier base 104.

The flexible membrane 110 is connected to and extends beneath the carrier base 104. The flexible membrane 110 is a generally circular sheet formed of a flexible and elastic material, such as a high strength silicone rubber, and includes an inner annular flap 162*a*, a middle annular flap 162*b*, and an outer annular flap 162*c*. The flaps 162*a*–162*c* may be generally concentric. An annular lower flange 164 may be secured to a bottom surface 166 of the carrier base 104. The inner and middle flaps 162*a* and 162*b* are clamped between the lower flange 164 and the carrier base 104 to define the inner and middle chambers 112 and 114, whereas the outer flap 162*c* is clamped between the retaining ring 108 and the carrier base 104 to define the outer chamber 116. The lower surface of the flexible membrane provides the substrate mounting surface.

The flexible membrane 110 may include a circular inner portion 172, an annular middle portion 174, and an annular outer portion 176 located beneath the inner chamber 112, middle chamber 114, and outer chamber 116, respectively. As such, the pressures in the chambers 112, 114 and 116 can independently control the downward pressure applied by the respective flexible membrane portions 172, 174 and 176.

The retaining ring 108 may be a generally annular ring secured at the outer edge of the carrier base 104 around the substrate mounting surface. The retaining ring has an inner surface 140 (see also FIG. 4) which defines, in conjunction with the lower surface of the flexible membrane 110, a substrate receiving recess 118. During polishing, the retaining ring 108 holds the substrate in the substrate receiving recess 118 and transfers the lateral load from the substrate to the carrier base 104. The retaining ring 108 may be formed of a hard plastic or ceramic material, and may be secured to the carrier base 104 by, for example, a retaining piece 136. The retaining piece may be secured, in turn, to the carrier base 104 by, for example, bolts 138.

Figure 4:
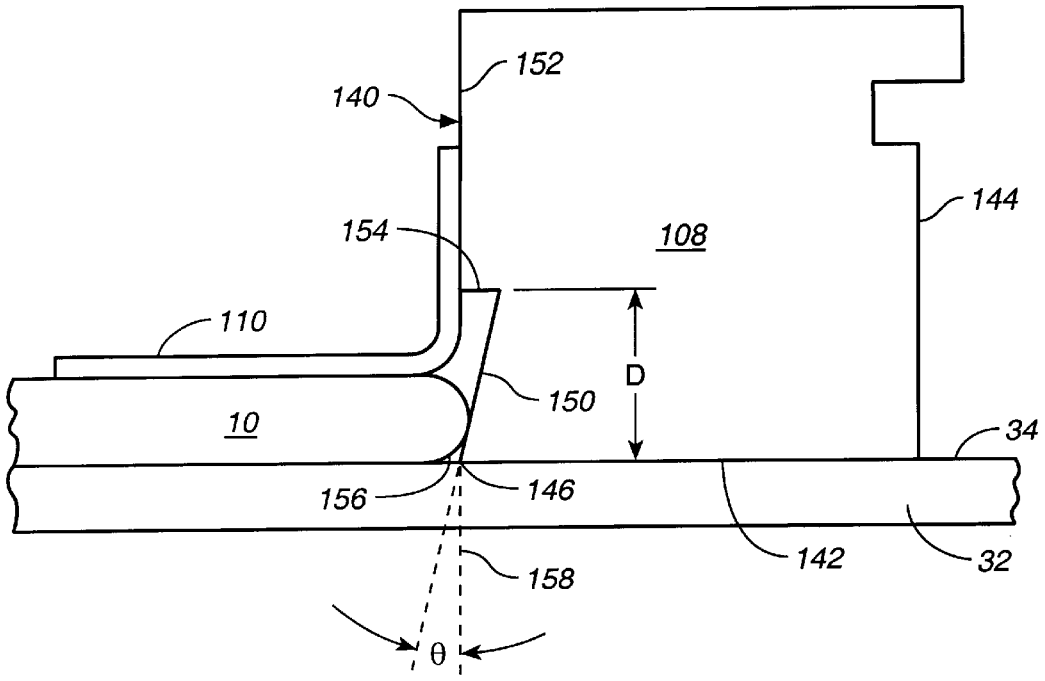
FIG. 4 is an enlarged view of the retaining ring of the carrier head of FIG. 3.

Referring to FIG. 4, the retaining ring 108 has a lower surface 142 which can contact a surface 34 of the polishing pad 32 during polishing. The lower surface 142 may be substantially flat, or it may have grooves or channels to carry slurry from an outer surface 144 of the retaining ring to the substrate.

The inner surface 140 of the retaining ring 108 includes an inclined portion 150 which extends downwardly to join to the lower surface 142 at a retaining ring edge 146. The inner surface 140 may also include a generally vertically-extending portion 152 and an overhang 154 that joins the vertical portion 152 to the inclined portion 150. The inclined portion 150 may be formed by grinding or milling the inner surface 140 of the retaining ring 108.

Figure 5:
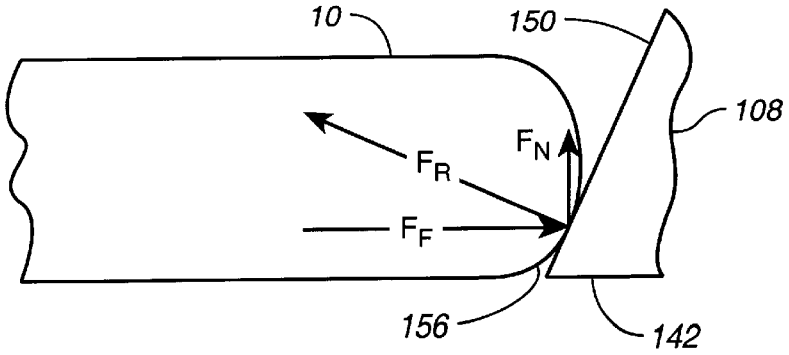
FIG. 5 is a schematic diagram of the forces applied to the substrate during polishing.

Assuming that the edge effect results in over-polishing of the perimeter of the substrate, the inclined portion 150 is sloped "inwardly", i.e., so that the inner diameter of the retaining ring 108 in the included portion 150 reaches its minimum at the retaining ring edge 146. Referring to FIG. 5, the frictional force of the polishing pad against the substrate forces the substrate toward the leading side of the carrier head, i.e., in the same direction as the rotation of the polishing pad. This drives an edge 156 of the substrate 10 against the inclined portion 150 with a frictional force $F_F$. The force of the substrate against the retaining ring results in a reactive force $F_R$ which is substantially perpendicular to the inclined portion 150. Although the horizontal component of the reactive force $F_R$ cancels the frictional force $F_F$, the resulting net force $F_N$ at the substrate edge 156 is directed away from the polishing pad. Consequently, the inclined portion 150 tends to lift the substrate edge away from the polishing pad. Assuming that the carrier head otherwise applies a uniform load to the substrate, the upward or vertical force $F_N$ will tend to reduce or eliminate the downward pressure at the perimeter of the substrate. Since the pressure at the substrate edge is reduced, the polishing rate at the periphery of the substrate will decrease, thereby ameliorating the edge effect.

The dimensions of the retaining ring required to minimize the edge effect may be determined experimentally, and may depend upon the pad and slurry composition, the rotation rates of the platen and carrier head, and the pressure on the substrate. For example, the angle $\Theta$ between the inclined portion 150 and a vertical axis 158 perpendicular to the polishing surface 34 may be between about 7° and 15°. The inclined portion may extend a distance D of about ⅛ inch upwardly along the inner surface 140.

Figure 6A:
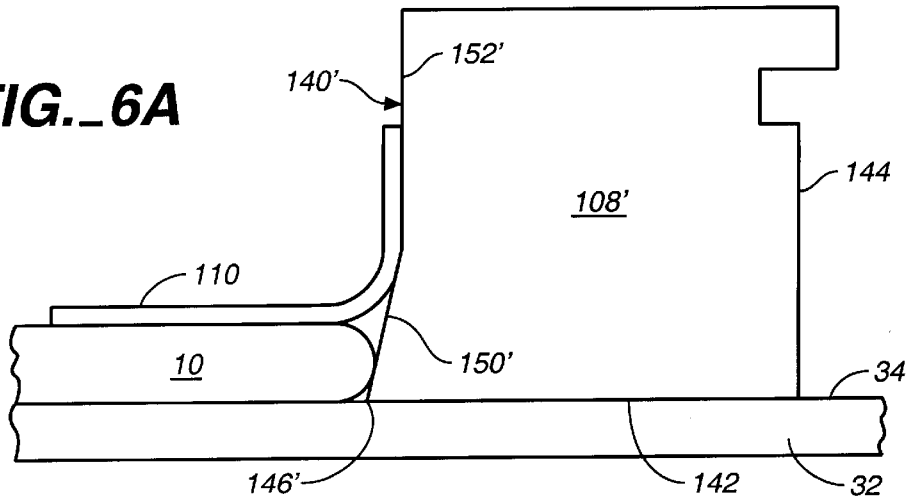
FIGS. 6A–6C are schematic cross-sectional views showing alternate embodiments of the retaining ring.
Figure 6B:
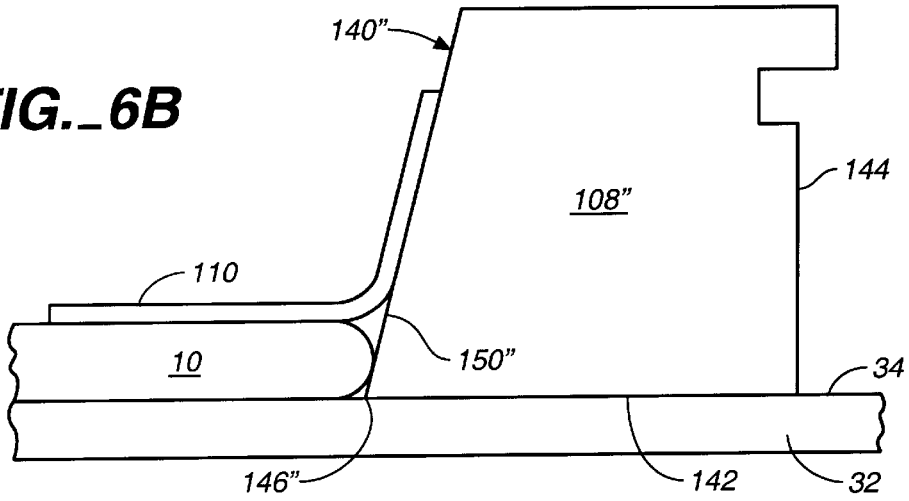

As shown in FIG. 6A, the retaining ring 108' could be constructed without an overhang in the inner surface 140'. Alternately, as shown in FIG. 6B, the entire inner surface 140" of the retaining ring 108" could be inclined. The embodiments of FIGS. 6A and 6B should provide the same advantages as the embodiment of FIG. 5.

Figure 6C:
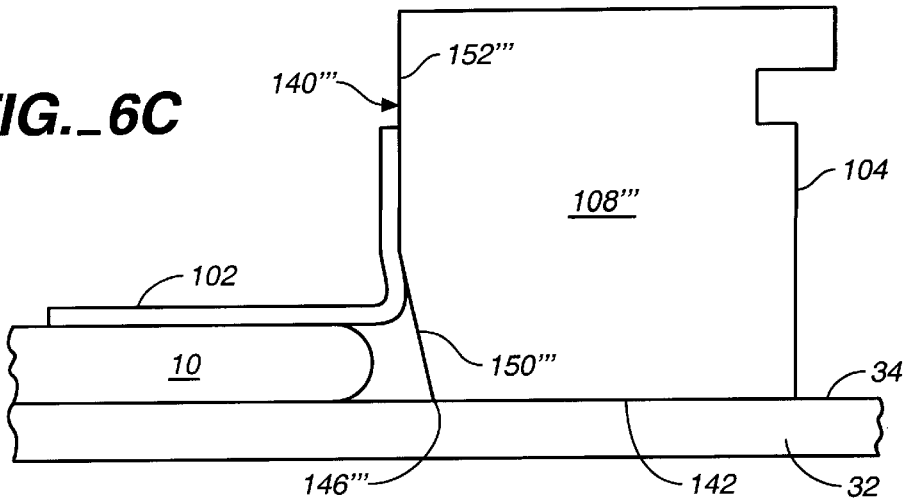

Referring to FIG. 6C, if the edge effect results in under-polishing of the perimeter of the substrate, the slope of the inclined portion 150''' may be reversed so that it is sloped "outwardly", i.e., so that the inner diameter of the retaining ring 108 is greatest at the retaining ring edge 146'''. In this case, the net force resulting from the pressure of the substrate against the inner surface 140''' will be directed downwardly, thereby increasing the pressure at the substrate edge. Thus, the retaining ring 108''' will increase the polishing rate at the substrate edge.

The present invention is described in terms of the preferred embodiment. The invention, however, is not limited to the embodiments depicted and described herein. Rather, the scope of the invention is defined by the appended claims.

What is claimed is:

1. A carrier head for a chemical mechanical polishing system, comprising:

a substrate mounting surface; and a retaining ring to maintain a substrate beneath the mounting surface, the retaining ring having an inner surface with an inclined region sloped outwardly such that the inner radius is greatest at the bottom of the retaining ring, the inclined region positioned to contact an edge of a substrate if the substrate is located adjacent the mounting surface and is being polished to apply a force having a vertical component to the edge of the substrate.

2. The carrier head of claim 1 wherein the vertical component of the force tends to press the edge of the substrate toward a polishing pad during polishing.

3. The carrier head of claim 1 wherein a lower surface of the retaining ring contacts a polishing pad during polishing.

4. The carrier head of claim 1 wherein there is an angle $\theta$ between the inclined region and an axis substantially perpendicular to a surface of a polishing pad against which the substrate is pressed during polishing.

5. The carrier head of claim 4 wherein the angle $\theta$ is between about 7 and 13 degrees.

6. The carrier head of claim 1, wherein the retaining ring is substantially annular in shape.

7. A chemical mechanical polishing system, comprising:

a rotatable polishing pad;

a slurry supply port to dispense a slurry onto the polishing pad;

a carrier head having a substrate mounting surface and a retaining ring to maintain a substrate beneath the mounting surface on the polishing surface, the retaining ring having an inner surface with an inclined region that is sloped outwardly such that the inner radius is greatest at the bottom of the retaining ring, the inclined region positioned to contact an edge of a substrate if the substrate is located adjacent the mounting surface and is being polished to apply a force having a vertical component to the edge of the substrate.

8. A method of polishing a substrate, comprising:

positioning a substrate adjacent a mounting surface of a carrier head, the carrier head including a retaining ring having an inner surface with an inclined region that is sloped outwardly such that the inner radius is greatest at the bottom of the retaining ring;

contacting the substrate with a polishing pad; and moving the polishing pad relative to the substrate so that the substrate is urged against the retaining ring and the inclined region generates a force having a vertical component that presses the edge of the substrate toward the polishing pad.

9. The method of claim 8 wherein there is an angle θ between the inclined region and an axis substantially perpendicular to a surface of the polishing pad.

10. The method of claim 9 wherein the angle θ is between about 7 and 13 degrees.

* * * * *